US007641296B2

(12) United States Patent
Le

(10) Patent No.: US 7,641,296 B2
(45) Date of Patent: Jan. 5, 2010

(54) SELF-MOVING MECHANISM AND SLIDE INCORPORATING THE SAME

(75) Inventor: Baoloc T. Le, La Puente, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 482 days.

(21) Appl. No.: 11/263,682

(22) Filed: Oct. 31, 2005

(65) Prior Publication Data

US 2006/0175946 A1 Aug. 10, 2006

Related U.S. Application Data

(60) Provisional application No. 60/625,474, filed on Nov. 5, 2004.

(51) Int. Cl.
*A47B 95/00* (2006.01)

(52) U.S. Cl. ..... 312/333; 312/319.1

(58) Field of Classification Search ..... 312/319.1, 312/333, 334.44, 334.46
See application file for complete search history.

(56) References Cited

U.S. PATENT DOCUMENTS

| | | | | |
|---|---|---|---|---|
| 930,534 | A | 8/1909 | Cox | |
| 3,104,142 | A | 9/1963 | Knape et al. | |
| 3,139,313 | A | 6/1964 | Rule | |
| 3,243,247 | A | 3/1966 | Knape | |
| 3,506,292 | A | 4/1970 | Hagendoorn et al. | |
| 3,574,437 | A | 4/1971 | Stein et al. | |
| 3,666,342 | A | 5/1972 | Biesecker | |
| 3,697,140 | A | 10/1972 | Livingston | |
| 3,700,301 | A | 10/1972 | Boeck | |
| 3,713,681 | A | 1/1973 | Worley | |
| 3,716,279 | A | 2/1973 | Anderson et al. | |
| 3,954,315 | A | 5/1976 | Sanden | |
| 3,973,814 | A | 8/1976 | Entrikin | |
| 3,976,342 | A * | 8/1976 | Leyendecker et al. | 384/293 |
| 4,006,951 | A | 2/1977 | Geer et al. | |
| 4,116,512 | A | 9/1978 | Wiser | |

(Continued)

FOREIGN PATENT DOCUMENTS

DE 41 24512 A1 2/1992

(Continued)

OTHER PUBLICATIONS

FR 5000 Full-Extension Ballbearing Drawerslide, Fulterer, p. 39.

(Continued)

*Primary Examiner*—José V Chen
*Assistant Examiner*—Matthew W Ing
(74) *Attorney, Agent, or Firm*—Christie, Parker & Hale, LLP.

(57) ABSTRACT

A self-moving mechanism, a slide incorporating the same and a method of self-moving a slide are provided. A slide incorporating a self-moving mechanism is a self-moving slide and includes a first slide member slideably coupled to a second slide member. A self-moving mechanism is coupled to the second slide member. A slot having a first longitudinal portion and a second transverse portion is formed on a housing of the mechanism. A slider having an actuator is guided within the slot and slides along the housing and couples with the first slide member for moving the first slide member relative to the second slide member.

24 Claims, 9 Drawing Sheets

U.S. PATENT DOCUMENTS 4,138,174 A 2/1979 Cox et al.
4,155,610 A 5/1979 Englund
4,159,153 A 6/1979 Yoshikawa
4,423,914 A 1/1984 Vander Ley
4,494,806 A 1/1985 Williams et al.
4,501,455 A 2/1985 Groseck
4,600,255 A 7/1986 Dubarko
4,615,095 A 10/1986 Bessinger et al.
4,653,820 A 3/1987 Tazaki
4,679,950 A 7/1987 Delmege et al.
4,811,579 A 3/1989 Lyons et al.
4,872,734 A 10/1989 Rechberg
5,015,048 A 5/1991 Brunnert
5,020,868 A 6/1991 Brunnert
5,033,805 A 7/1991 Hobbs
5,040,833 A 8/1991 Brunnert
5,040,858 A 8/1991 Kruse et al.
5,056,879 A 10/1991 Röck et al.
5,207,781 A 5/1993 Röck
5,226,716 A 7/1993 Geil
5,232,278 A 8/1993 O'Brien et al.
5,240,318 A 8/1993 Schröder et al.
5,255,983 A 10/1993 Parvin
5,302,016 A 4/1994 Lautenschläger et al.
5,312,180 A 5/1994 Tieder et al.
5,364,179 A 11/1994 Brüstle et al.
5,388,902 A 2/1995 Huebschen et al.
5,421,481 A 6/1995 Fortmann et al.
5,433,517 A 7/1995 Fleisch
5,442,885 A * 8/1995 Laven et al. ..... 52/844
5,474,375 A 12/1995 Hollenstein et al.
5,484,209 A 1/1996 Weng
5,520,452 A 5/1996 Petersen et al.
5,542,759 A 8/1996 Krivec
5,580,138 A 12/1996 Grabher
5,671,988 A 9/1997 O'Neill
5,671,989 A 9/1997 Lautenschläger
5,681,066 A 10/1997 Anderson
5,730,514 A 3/1998 Hashemi
5,733,027 A 3/1998 Lautenschläger
5,909,935 A 6/1999 Esperandieu et al.
5,944,396 A 8/1999 Stephan
5,961,193 A 10/1999 Hobbs
5,975,662 A 11/1999 Weber
6,254,205 B1 7/2001 Wright et al.
6,254,209 B1 * 7/2001 Parvin ..... 312/334.44
6,340,078 B1 1/2002 Scheible
6,412,891 B1 7/2002 Liang et al.
6,499,819 B2 * 12/2002 Hoeppner ..... 312/334.44
6,666,306 B2 12/2003 Gasser
6,712,435 B2 3/2004 Kim et al.
6,733,097 B2 5/2004 Kim et al.
6,752,478 B1 6/2004 Francz
6,953,233 B2 10/2005 Lam et al.
6,971,729 B1 12/2005 Kim et al.
2002/0011766 A1 * 1/2002 Kim et al. ..... 312/319.1
2002/0033658 A1 3/2002 Salice
2003/0067257 A1 4/2003 Gasser
2003/0075845 A1 4/2003 Krammer
2004/0000850 A1 * 1/2004 Lam Harn et al. ..... 312/333
2004/0107536 A1 6/2004 Hollenstein

FOREIGN PATENT DOCUMENTS

DE 91 14 787.5 U1 2/1992
DE 297 01 895.7 3/1997
EP 0 386 731 B1 9/1990
EP 0 391 221 A1 10/1990
EP 0 529 679 B1 3/1993
EP 0 552 500 A1 7/1993
JP 405317133 A 12/1993

OTHER PUBLICATIONS

Selby On-Line Furniture Brochure, "Drawer Slides", Selby Furniture Hardware Co., Inc.—The Houdini of Hardware, May 2, 2003, 3 pages.

* cited by examiner

SELF-MOVING MECHANISM AND SLIDE INCORPORATING THE SAME

CROSS REFERENCE TO RELATED APPLICATION

This application is based upon and claims priority on U.S. Provisional Application No. 60/625,474 filed on Nov. 5, 2004, the contents of which are fully incorporated herein by reference.

BACKGROUND OF THE INVENTION

The present invention is directed to self-moving slides, self-moving mechanisms for slides, and to methods for self-moving slides. Drawers are typically coupled to cabinets using slides. These slides are typically two-member slides or three-member slides. A two-member slide includes a stationary member and a telescoping member. The telescoping member is slideably coupled to the stationary member and can telescope relative to the stationary member. A three-member slide includes three members, namely, a stationary member, an intermediate member, and a telescoping member. The intermediate member is slideably coupled to the stationary member and the telescoping member is slideably coupled to the intermediate member. Both the intermediate and telescoping members telescope relative to the stationary member. Moreover, the telescoping member can telescope relative to the intermediate member. Typically the slide stationary member is coupled to the cabinet and the telescoping member is coupled to a side of the drawer.

The problem with many drawers is that they tend to open after they are closed. Another problem with drawers is that when they are pushed to close, they sometimes do not close completely because they are not pushed with sufficient force or alternatively they are pushed with more force than necessary causing the drawers to slam against the cabinet and then re-open. Another problem is that the drawers do not open easily.

Consequently, a mechanism is desired for use in slides that will keep the slides in a closed position when the slides are fully closed and that will also help the slides self-close as they reach close to the end of their rearward travel. Similarly, a mechanism is also desired for use in slides that will help self-open such slides.

SUMMARY OF THE INVENTION

A self-moving mechanism, a slide incorporating the same and a method of self-moving a slide are provided. An exemplary embodiment self-moving mechanism has an elongated housing. A guide slot having a first longitudinal portion and a second transverse portion is formed on the housing. A slider having an actuator is guided within the guide slot and slides along the housing. In an exemplary embodiment, the actuator is guided along the longitudinal portion of the guide slot as the slider slides along the housing. To enter the transverse portion of the guide slot, the slider rotates causing the actuator to move into the transverse portion of the guide slot. The actuator engages a setter coupled to an extendible slide member which is slideably coupled to another slide member. In an exemplary embodiment, the slider is spring coupled to the housing. In another exemplary embodiment, the slider may be spring coupled to the slide member on which the mechanism is mounted.

In another exemplary embodiment, a self-moving slide is provided having a first slide member, a second slide member slideably coupled to the first slide member, and a self-moving mechanism mounted on the second slide member. In an exemplary embodiment, the self-moving mechanism includes a housing having a slot and an inner surface having a portion having a shape of at least a cylindrical section. The exemplary mechanism also includes a slider having a body having an outer surface having at least a generally cylindrical section and a projection extending from the body and penetrating the slot for coupling with the first slide member for moving the first slide member. In an exemplary embodiment, a spring is coupled to the slider and the housing for moving the slider. In a further exemplary embodiment, the slot includes a first portion and a second portion, wherein the second portion is wider than the first portion and wherein a shoulder is defined by the second portion adjacent the first portion. In another exemplary embodiment, the slider rotates relative to the housing allowing the slider projection to slide over the shoulder when in the slot second portion. In yet a further exemplary embodiment, when the slider projection is over the shoulder, the spring generates a force urging the projection against the shoulder.

In yet another exemplary embodiment, the spring is coupled to the slider and the housing for moving the slider. The spring has a first neck portion proximate a first end of the spring. The first neck portion has a diameter smaller than a diameter of the first end of the spring. The housing also includes a notch at a first end of the housing. The diameter of the spring first end is greater than a width of the notch, and the first neck portion is fitted within said notch. In another exemplary embodiment, the spring includes a second neck portion proximate a second end of the spring opposite the first end, wherein the spring second end is coupled to the body and wherein the second neck portion is fitted within a second notch defined on a wall extending from the inner surface of the housing. The spring may also generate a force urging the slider against the wall. In yet a further exemplary embodiment, the spring second end is fitted in a slot formed on the slider body, wherein the slot formed on the slider body includes a wider section to accommodate the second end of the spring and a narrower section extending from the wider section to accommodate a portion of the second neck portion. The slot formed on the slider body axially retains the second end of the spring relative to the body.

In yet a further exemplary embodiment, the self-moving slide also includes a setter extending from the first slide member. The setter may include a flexible portion. The slider projection engages the setter for coupling the setter to the first slide member for moving the first slide member relative to the second slide member. The slider may be separated from the first slide member and may be coupled to the first slide member.

In an exemplary embodiment, the housing includes an outer surface having a generally cylindrical section shape, wherein the housing slot is formed through said outer surface cylindrical section, wherein the setter comprises a surface having a generally cylindrical section shape, wherein the setter surface slides over the housing outer surface having a generally cylindrical section shape. The setter may include a slot for receiving the slider projection. The slot is defined between first and second slot edges. The slider projection may slide between a first position within the first portion of the housing slot and a second position within the second portion of the housing slot. When the first slide member is extended relative to the second slide member, the setter causes the slider projection to slide to the second position against a force generated by the spring and the first edge of the setter causes the slider projection to rotate over the slot shoulder, and the spring force causes the projection to engage the slot shoulder. When retracting the first slide member relative to the second slide member, the second edge of the setter engages the slider projection causing the slider to rotate to a position where the spring force causes the slider to slide toward the first position along the housing slot. When sliding toward the first position, the projection applies a force on the setter for moving the first slide member.

In an exemplary embodiment, the housing is formed from plastic. The housing may also include a cutout formed through the housing proximate an end of the housing slot first portion opposite the housing slot second portion for increasing the flexibility of a portion of housing proximate the cutout. In an exemplary embodiment, the setter causes the slider to rotate and the slider projection to engage and flex the portion of the housing proximate the cutout allowing the slider projection to reengage the setter. This occurs when the first slide member is retracted relative to the second slide member, in cases where the slide member projection is disengaged from the setter.

In any of the aforementioned exemplary embodiments, the slider body includes a depression housing a lubricant. In this regard, the slider body may be self-lubricating.

In a further exemplary embodiment, the housing includes a slanted upper surface. A tab extends from the second slide member and engages the slanted upper surface of the housing retaining the housing on the second slide member.

In another exemplary embodiment, a self-moving slide is provided including a first slide member, a second slide member slideably coupled to the first slide member, and a setter extending from the first slide member and having a compressible portion. A self-moving mechanism is mounted on the second slide member. The self-moving mechanism includes a housing having a slot, and a slider having a body and a projection extending from the body. The projection penetrates the slot and couples with the setter for moving the first slide member. In another exemplary embodiment, the slider moves from a first position to a second position to move the first slide member. When the slider is in the second position, the projection compresses the compressible portion of the setter when the first slide member is retracted from an extended position relative to the second slide member.

DETAILED DESCRIPTION OF THE INVENTION

The present invention is directed to self-moving mechanisms for use in slides, to slides incorporating the same and to methods of self-moving slides. Exemplary embodiment self-moving mechanisms of the present invention are coupled to slides for opening or closing the slides. Consequently, slides incorporating such mechanisms become self-moving slides, as for example self-opening or self-closing slides. The self-moving slides may be used to couple a drawer to a cabinet or to couple any other movable member, as for example a tray, to a stationary member.

Figure 1:
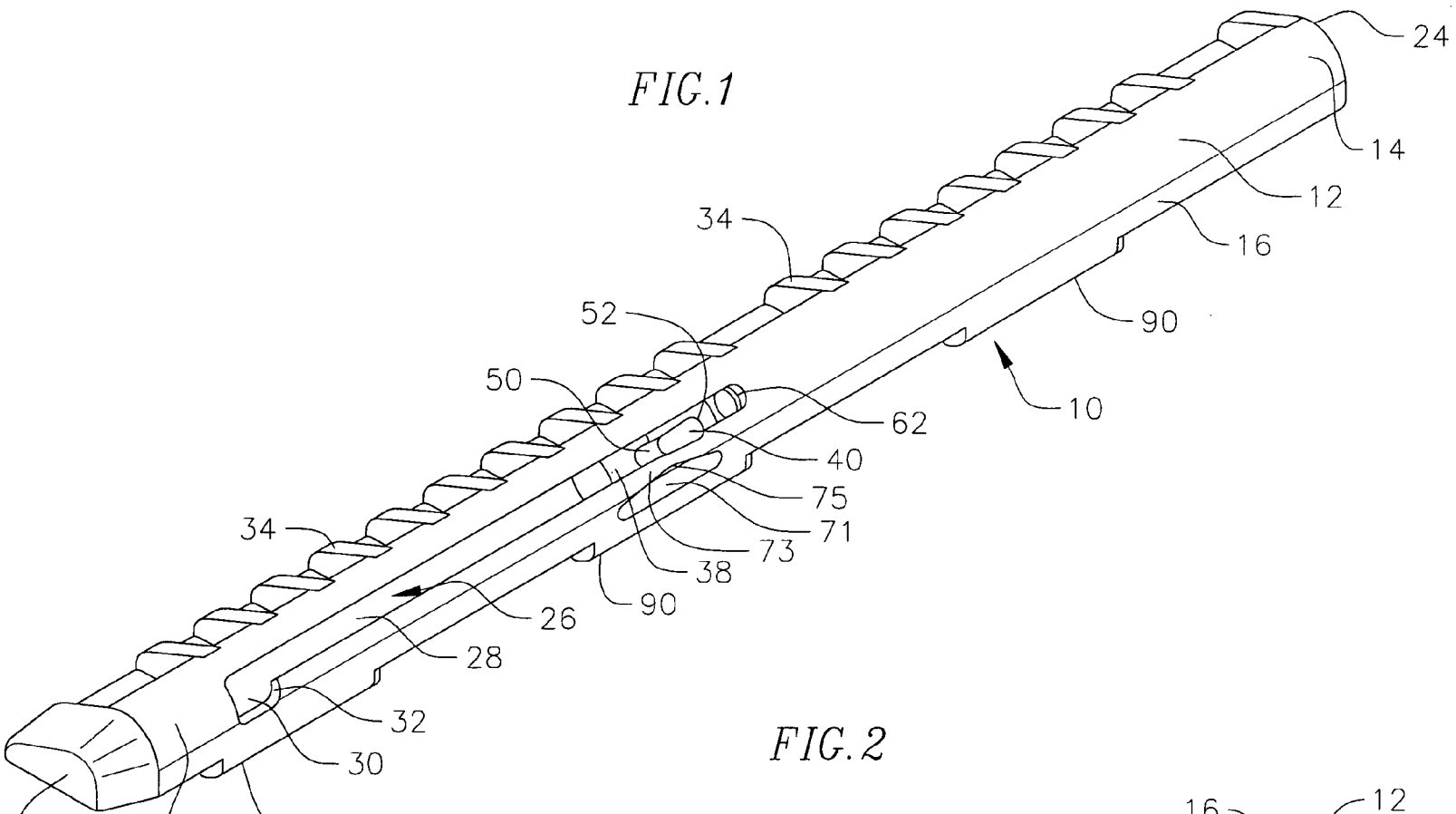
FIG. 1 is a perspective view of an exemplary embodiment self-moving mechanism of the present invention.
Figure 2:
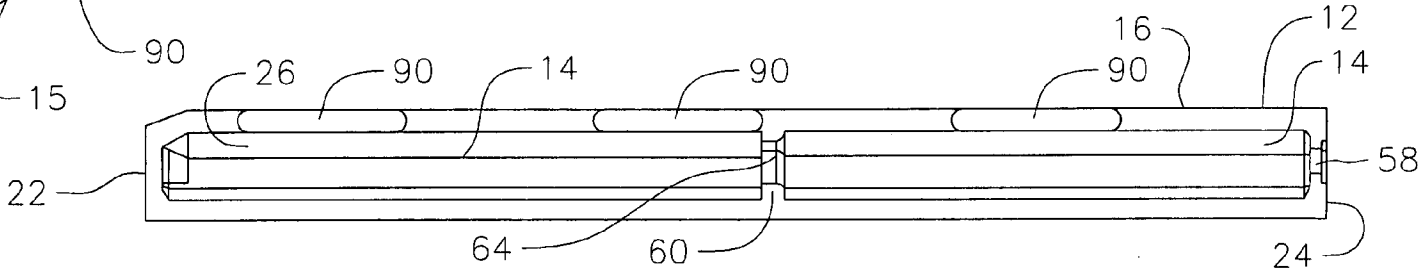
FIG. 2 is a bottom view of an exemplary embodiment housing of an exemplary embodiment self-moving mechanism of the present invention.
Figure 3:
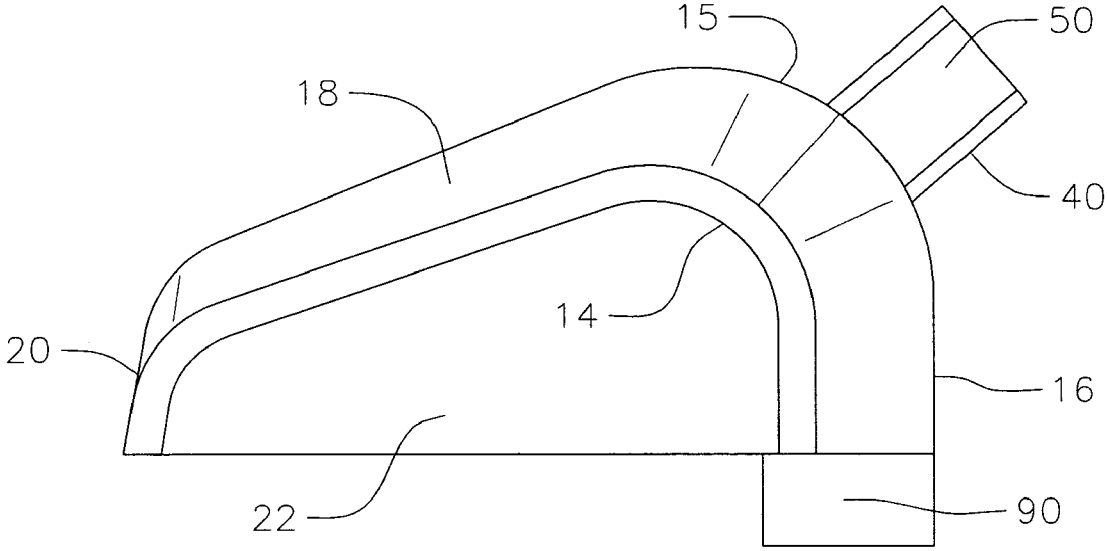
FIGS. 3 and 4 are opposite end views of an exemplary embodiment self-moving mechanism of the present invention.

An exemplary embodiment self-moving mechanism 10 includes an elongated housing 12, as shown in FIG. 1. In an exemplary embodiment as shown in FIG. 2, a longitudinal section 14 of the housing inner surface is rounded, thereby defining a cylindrical surface section that spans at least the majority of the length of the housing. In an exemplary embodiment, the outer surface of the housing corresponding to the cylindrical inner surface section is also rounded, thereby in combination with the inner cylindrical surface section defining a cylindrical section 15. In an exemplary embodiment, the housing has a first sidewall 16, which may be generally vertical, from which extends the cylindrical section 15 from which extends an upper wall 18 that is slanted so as to decrease the height of the housing along the width of the housing (FIG. 3). A second generally downward vertical sidewall 20 may extend from the slanted upper wall. In an alternative exemplary embodiment, the upper wall 18 may extend to a level equal to a base of the first sidewall, thereby alleviating the need for a second vertical wall. In another exemplary embodiment the upper wall is not slanted or may be slanted in an opposite direction It should be understood that the terms "upper," "lower," "over," "below," "front," "back," "forward," "rearward," and "rear" are used to designate the relative locations between elements and not the exact locations of such elements. For example, a "lower" element may be located above an "upper" element under certain conditions, as for example when the part on which the element is formed is turned upside down.

The housing has a first end 22 opposite a second end 24 (FIGS. 1 2, 3, and 4). A guide slot 26 is formed through the housing cylindrical section proximate a location about mid-length of the housing and extends longitudinally to a location proximate the first end 22 of the housing (FIG. 1). The width of the slot is increased at the end of the slot proximate the first end of the housing. In this regard, a guide slot is defined having a first longitudinal portion 28 and a second transverse portion 30 which extends transversely from the first longitudinal portion. A shoulder 32 is defined between the first and second portions.

To increase the stiffness of the housing while minimizing the increase in weight, ribs 34 may be formed along the outer surface of the upper wall of the housing which extend transversely to the longitudinal axis of the housing.

Figure 5:
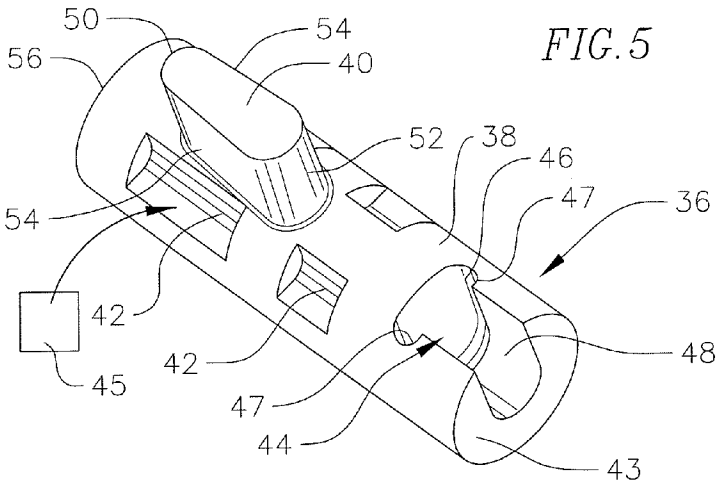
FIG. 5 is a perspective view of an exemplary embodiment slider for use in an exemplary embodiment self-moving mechanism of the present invention.

A slider 36 having a body 38 and an actuator 40 extending from the body is guided along the guide slot 26 (FIGS. 1 and 5). More specifically, the actuator penetrates the guide slot for guiding the slider along the guide slot. In an exemplary embodiment, the slider body 38 has a cylindrical section or is cylindrical, as for example shown in FIG. 5. In an exemplary embodiment, the cylindrical outer surface of the body is complementary to the cylindrical inner surface section 14 of the housing. In this regard, the slider body can slide relative to the cylindrical inner surface section of the housing, as well as rotate about the cylindrical section central longitudinal axis relative to the cylindrical inner surface, as for example shown in FIG. 6. Depressions 42 may be formed on the body of the slider to reduce its weight. The depression may also serve to provide a lubrication reservoir for storing a lubricant 45. In this regard, the body may self-lubricate itself during operation, prolonging the life of the body and the housing. Proximate one end 43 of the slider body 38 is formed a notch 44 which is stepped from a larger width 46 to a smaller width 48 which extends to the end 43 of the slider body. Consequently, shoulders 47 are defined at the interface between the two notch width sections.

In an exemplary embodiment, the actuator is a projection 40 which has a first rounded end 50 opposite a second rounded end 52. The two rounded ends are interconnected by two side surfaces 54. In an exemplary embodiment, the two rounded ends are semi-cylindrical with the second rounded end 52 having diameter greater than the diameter of the first rounded end 50. In an exemplary embodiment, the actuator is positioned closer to the end 56 of the slider that does not include the notch 44 (FIG. 5). Moreover, in an exemplary embodiment, the larger diameter rounded end 52 is positioned such that it is closer to the notched end 43 of the slider than the smaller diameter end 50. In another exemplary embodiment, the actuator may be any type of projection having various other types of geometries, as for example a cylindrical geometry.

Figure 4:
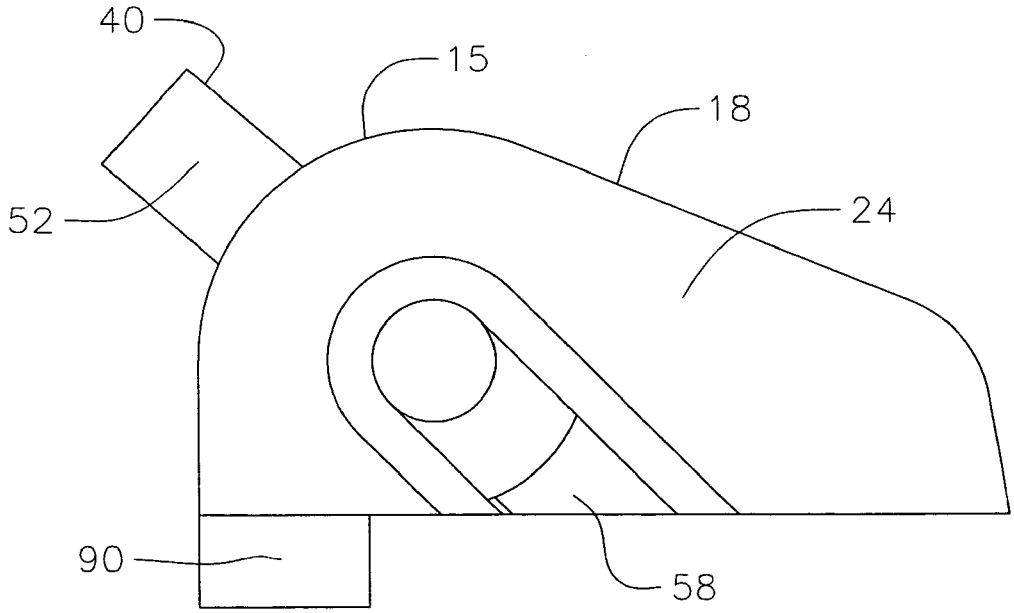
Figure 7:
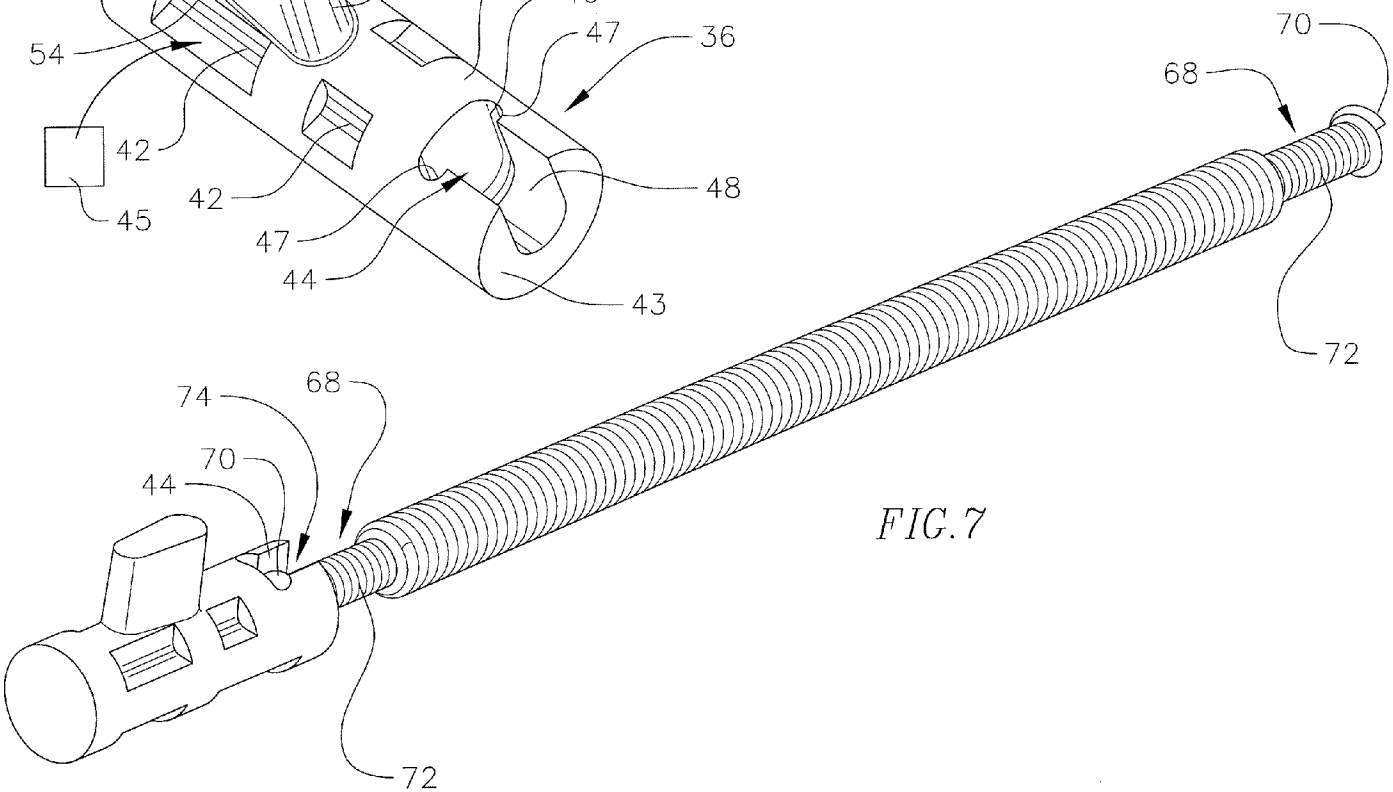
FIG. 7 is a perspective view of an exemplary embodiment slider and spring assembly for use in an exemplary embodiment self-moving mechanism of the present invention.
Figure 6:
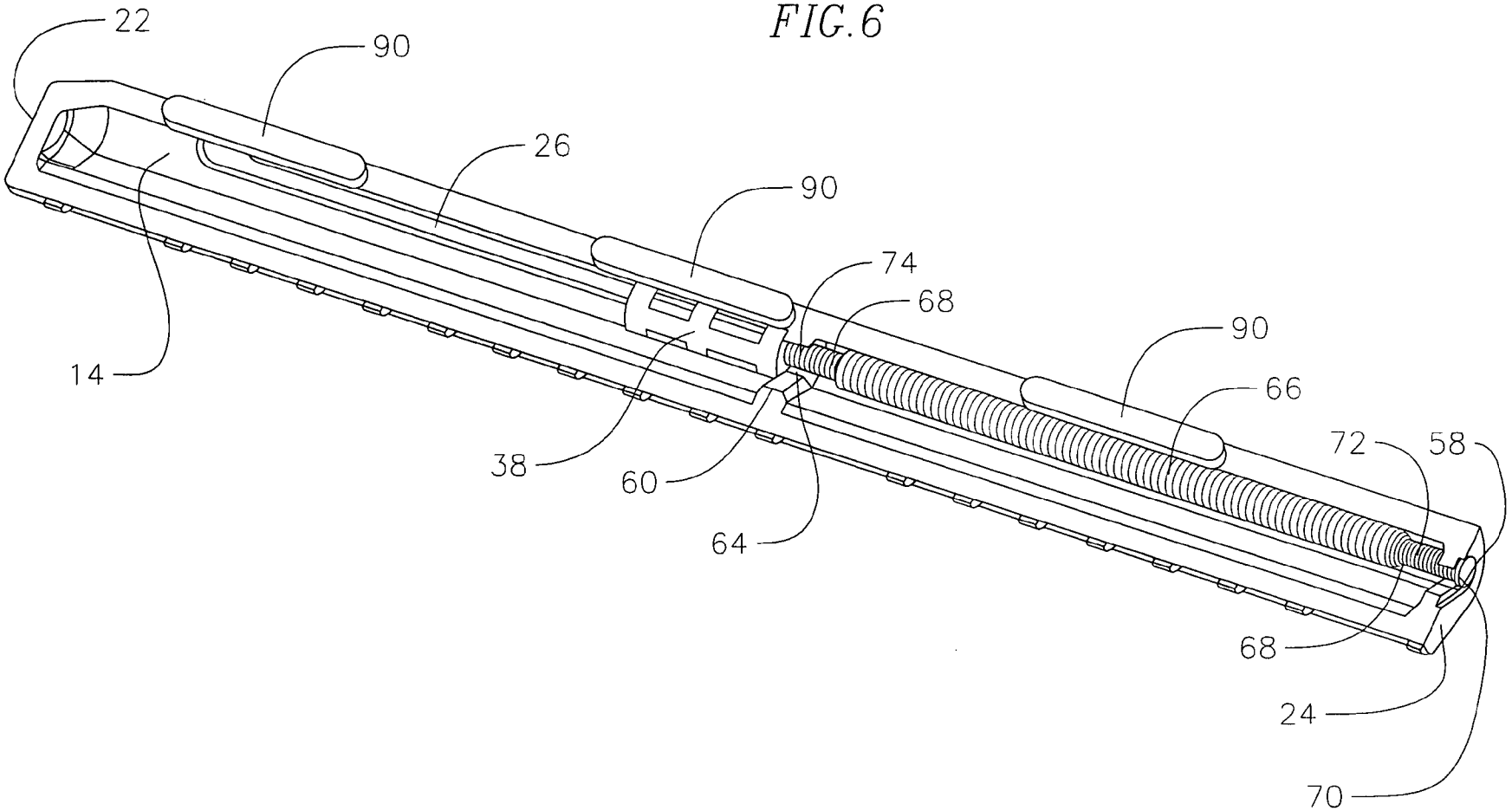
FIG. 6 is a perspective bottom view of an exemplary embodiment self-moving mechanism of the present invention.

In an exemplary embodiment, a notch 58 is formed on the second end 24 of the housing end wall, as for example shown in FIGS. 2, 4 and 6. A rib 60 is formed on the inner surface of the housing extending transversely to the longitudinal axis of the housing and proximate an end 62 of the first longitudinal portion 28 of the guide slot 26 opposite the transverse portion of the guide slot. A notch 64 is defined through the rib 60. A spring 66 having a diameter which decreases proximate each end portion 68 of the spring and then increases again at each end 70 of the spring is coupled to the slider 36 and to the second end surface 24 of the housing (FIGS. 6 and 7). Specifically, the reduced diameter portions of the spring define a neck section 72 at either end of the spring.

A first end portion 74 of the spring is received within the notch 44 on the slider such that the larger diameter end 70 is received within the larger width section 46 of the notch formed on the slider body and the smaller diameter section forming the neck 72 is received within the smaller width section 48 of the notch 44. In this regard, the shoulders 47 formed between the two width sections of the notch formed on the slider body axially retain the spring end 70 from axially withdrawing from the slider notch 44. The other neck 72 of the spring is positioned within the notch 58 formed on the second end 24 of the housing. In this regard, the other end 70 of the spring is axially retained by the end wall 24.

When the slider with spring are fitted within the housing, the slider is positioned within the housing on the side of the rib 60 closest to the housing first end 22 with the actuator 40 penetrating the guide slot 26 formed on the housing and the spring extending through the rib notch 64. As the other end of the spring is retained by the second end 24 of the housing, the spring which in an exemplary embodiment is a tension (i.e., an extension) spring is at least slightly extended generating a force which urges the slider against the rib. In this regard, the slider is retained within the housing by the force generated by the spring. In an exemplary embodiment, when the spring is fitted within the notch on the slider, the spring central longitudinal axis is aligned or is closely aligned with the central longitudinal axis of the cylindrical slider body 38.

In other exemplary embodiments, instead of an extension spring, a compression spring may be used. With such an embodiment, the spring end not connected to the slider is coupled to the first end 22 of the housing. In other exemplary embodiments, the spring may be coupled to other portions of the housing, as for example a notched rib formed in the housing. In yet further exemplary embodiments, other means may be used to couple the spring the slider and/or the housing. For example, the spring may be secured to the slider and/or the housing using fasteners.

In an exemplary embodiment, a slot 71 is defined on the first generally vertical sidewall 16 of the housing at a location proximate the actuator when the slider is being urged against the rib 60 by the spring. In this regard, the vertical thickness of the generally vertical first wall portion 73 between the guide slot and the slot 71 is reduced. Consequently, the flexibility of the portion 73 of the first wall is increased. In an exemplary embodiment, the slot has a composite shape in plan view comprising a rectangle under a triangle with the triangle vertex 75 positioned alongside the actuator 40 when the slider is urged against the rib 60. In this regard, the thinner and thus more flexible portion 73 of the first vertical wall is proximate the actuator when the slider is urged against the rib 60. In another exemplary embodiment, the slot 71 may be formed by a cut-out that extends to the lower base of the first sidewall 16.

Figure 8:
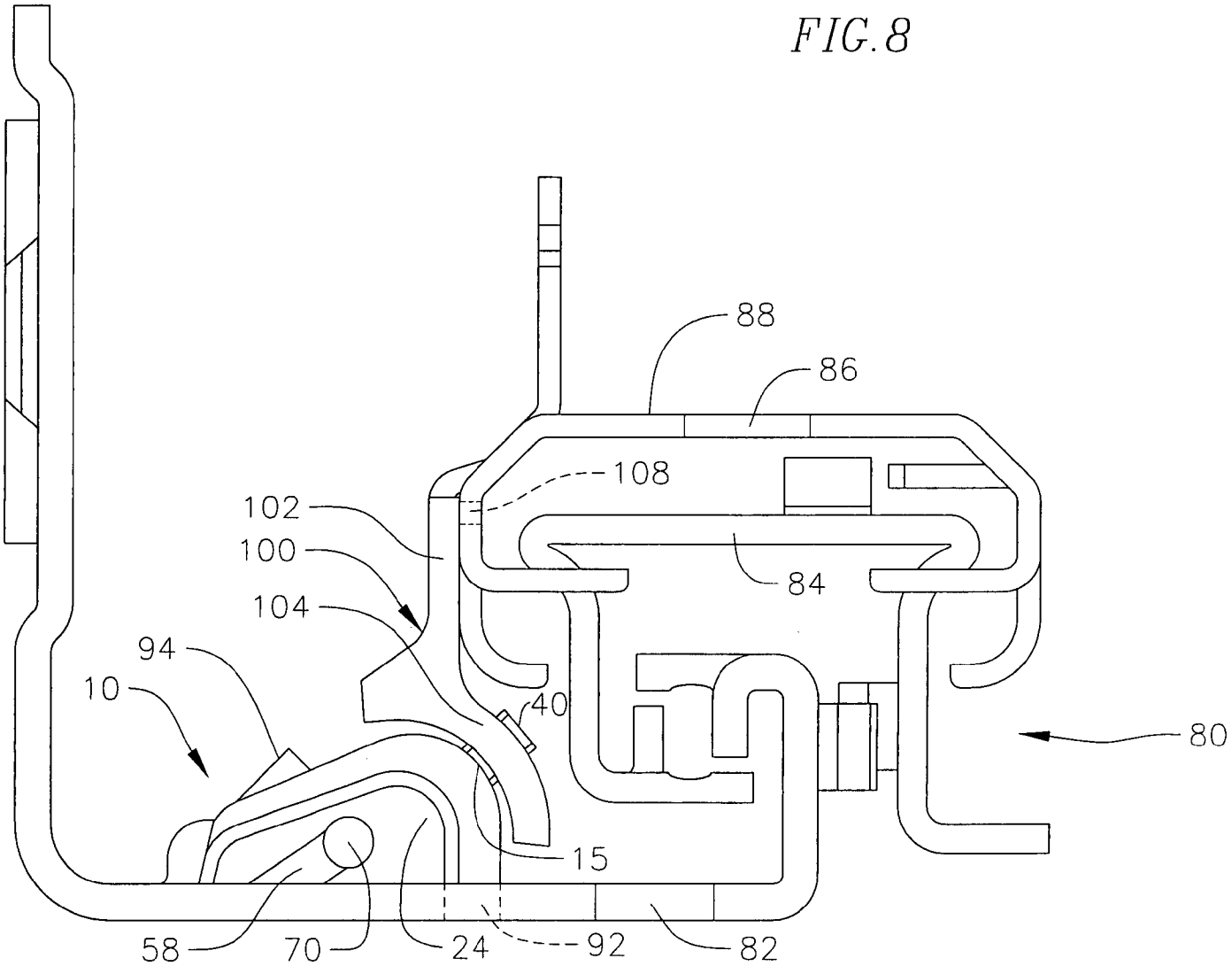
FIG. 8 is a rear end view of an exemplary embodiment self-moving mechanism mounted on an exemplary embodiment under-mount slide.

The self-moving mechanism of the present invention may be mounted on different types of slides. For illustrative purposes, the self-moving mechanism of the present invention is described as being mounted on an under-mount slide to act as a self-closing mechanism for self-closing the under-mount slide. An exemplary under-mount slide with an exemplary mechanism mounted thereon is shown in FIG. 8. The shown under-mount slide 80 has a stationary member 82 which is mounted on a cabinet or other stationary structure (not shown). An intermediate slide member 84 is slideably coupled to the stationary member 82. An extendible slide member 86 is slideably coupled to the intermediate member. A cabinet moveable member such as drawer is mounted on the extendible member, for example on an upper surface 88 of the extendible member. In an alternate exemplary embodiment, the slide may have only two slide members, as for example, an extendible member directly slideably coupled to a stationary member.

The slide members are slideably coupled to each other using bearings (not shown). Typically, two slides are used to couple a drawer or other cabinet component to a cabinet, one on each side of the drawer. In such case, a self-moving mechanism may be mounted on one or both slides.

To act as a self-closing mechanism, an exemplary embodiment mechanism is mounted on the stationary slide member 82 with the second end 24 of the housing nearer to the rear end of the stationary member than the housing first end 22. In the exemplary embodiment, the mechanism is mounted proximate to the rear end of the stationary slide member. In other exemplary embodiments, the mechanism may be positioned any where along the stationary slide member.

Figure 9:
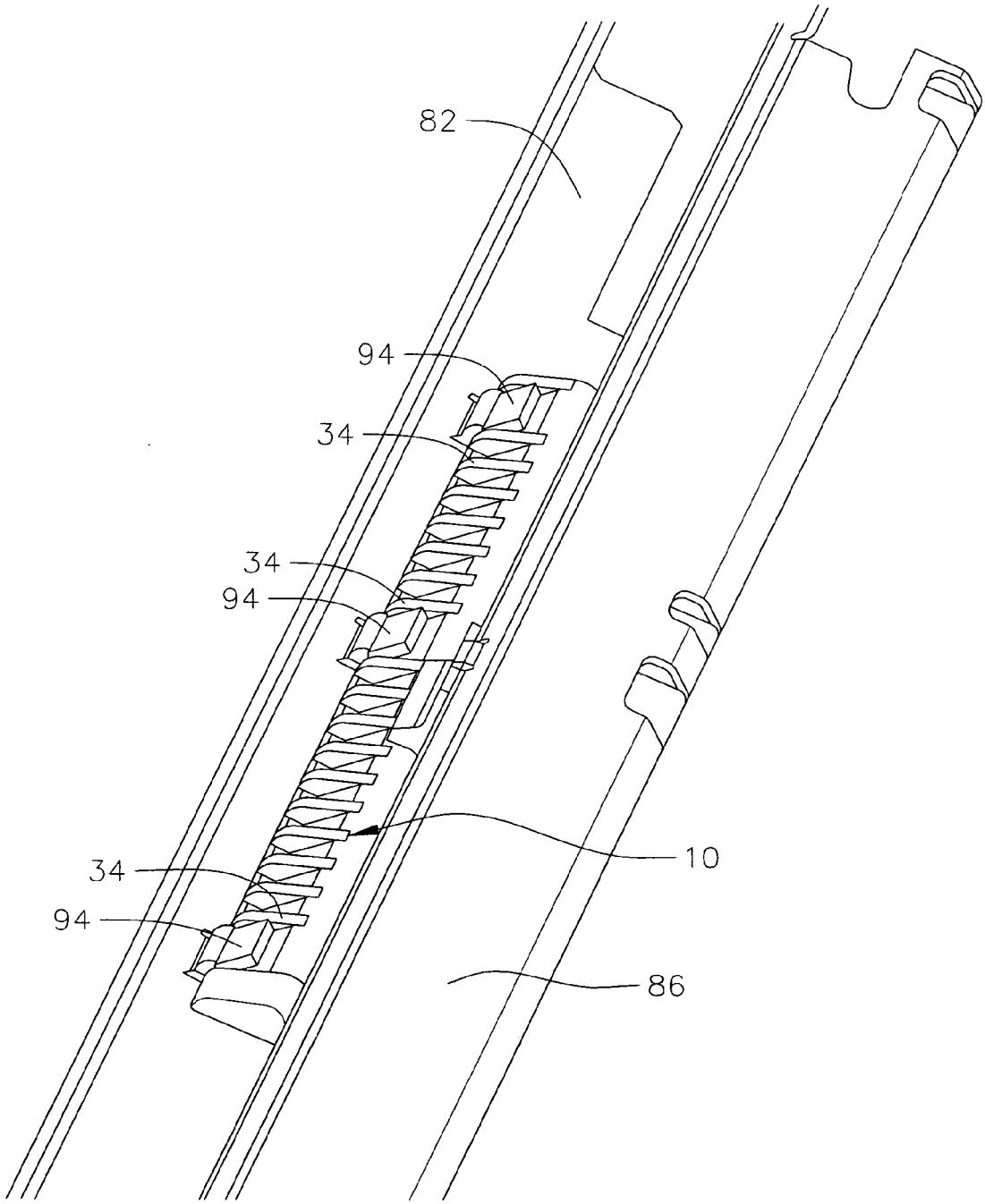
FIG. 9 is a perspective top view of an exemplary embodiment self-moving mechanism of the present invention mounted on an exemplary embodiment under-mount slide.

The self-moving mechanism may be mounted on the stationary slide member using various methods. In one exemplary embodiment, legs 90 extend below the base of the first generally vertical wall 16 of the housing. In the exemplary shown embodiment, three legs 90 spaced apart are formed extending from the lower edge of the first generally vertical side wall 16 (FIGS. 1-4 and 6). Corresponding openings 92 (FIG. 8) are formed through the stationary slide member to accommodate the legs. In an exemplary embodiment, tabs, as for example lance tabs 94, are formed on the stationary slide member 82 (FIG. 9). Each lance tab may be formed by bending a portion of the slide stationary member 82 upward.

To mount the self-moving mechanism onto the stationary member, the legs 90 formed on the housing are positioned so as to penetrate the openings 92 formed on the stationary slide member while the lance tabs 94 extend over the slanted upper wall 18 of the housing so as to retain the housing in position. The ribs 34 formed on the outer surface of the exemplary embodiment housing also provide barriers for preventing the axial movement of the housing relative to the lance tabs 94. In other exemplary embodiments, the housing may be fastened or adhered, or otherwise connected to the stationary slide member.

A setter 100 is mounted on the extendible slide member 86. In an exemplary embodiment, the setter comprises a generally vertical portion 102 which is coupled to the extendible slide member. The setter also includes a curved portion 104 extending from the vertical portion. The curved portion is configured so that it can slide over the cylindrical section 15 of the housing, as for example shown in FIG. 8. The setter is engageable with the actuator. The setter is mounted on a location on the extendible slide member that is determined by the location of the self-moving mechanism on the stationary member so that the setter may engage the actuator at the appropriate time. As used herein the term "setter" broadly means any structure which is engaged by the actuator.

Figure 10:
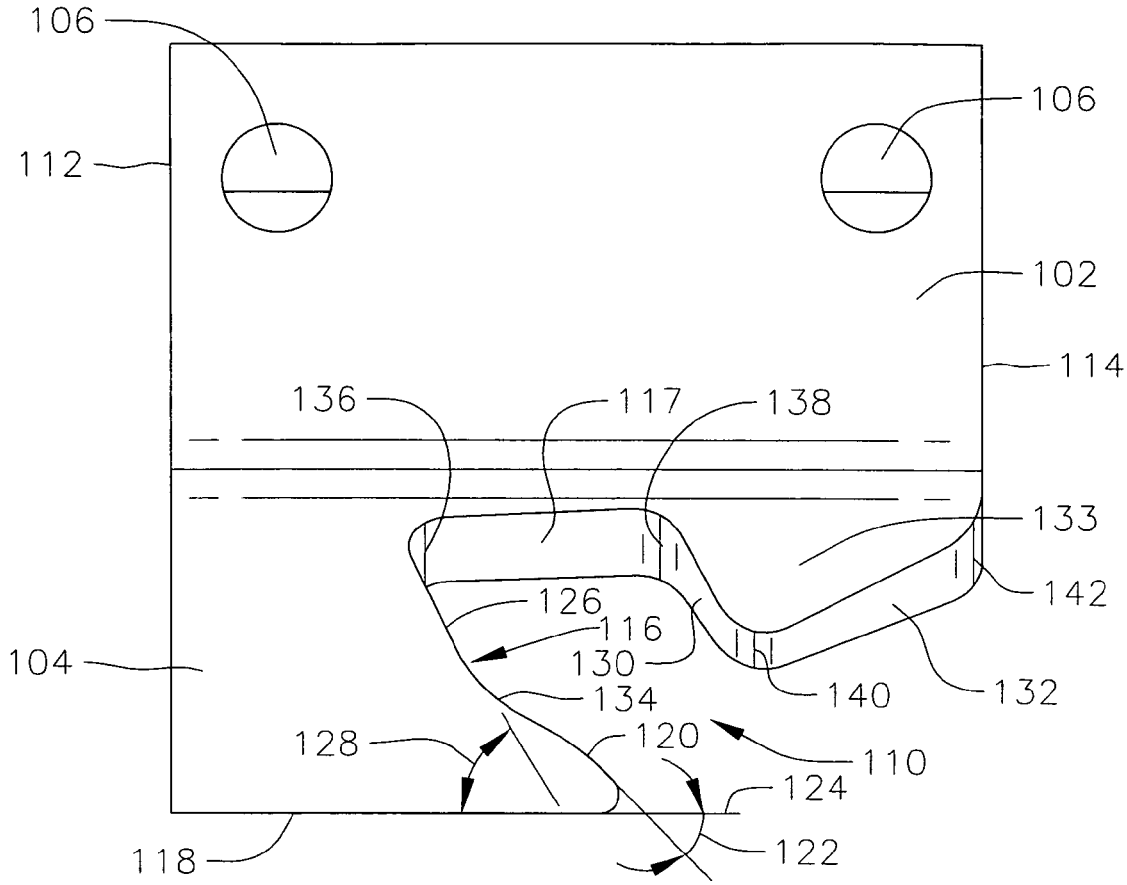
FIG. 10 is a side view of an exemplary embodiment setter used to engage an exemplary embodiment actuator of an exemplary embodiment self-moving mechanism of the present invention.
Figure 11:
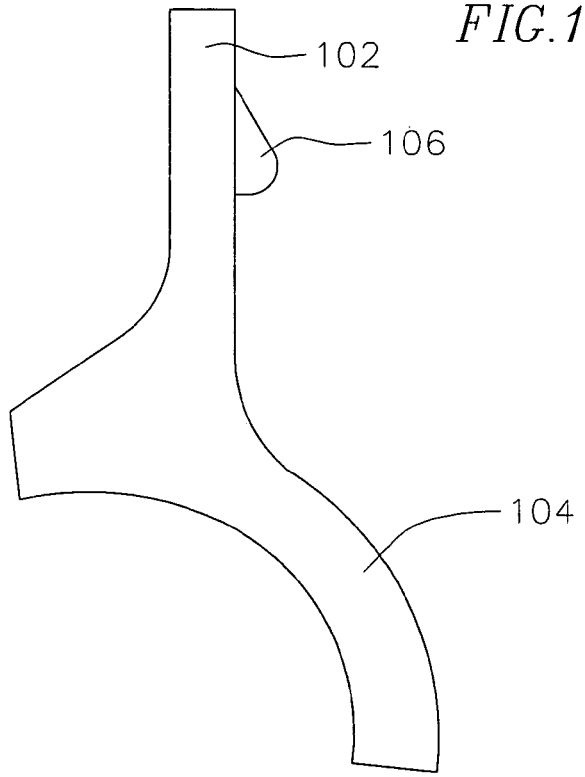
FIG. 11 is an end view of the exemplary embodiment setter shown in FIG. 10.

In an exemplary embodiment, the setter vertical portion 102 has two spaced apart projections 106 extending transversely there-from, as for example shown in FIGS. 10 and 11. The projections have a teardrop profile, as for example shown in FIG. 11, which allow them to snap into corresponding openings 108 formed on the extendible slide member 86, thereby coupling the setter to the extendible slide member. In other exemplary embodiments, the setter may be coupled to the extendible slide member using other means. For example, the setter may be fastened or bonded to the extendible slide member. In another exemplary embodiment, the setter may be formed as part of the extendible slide member and/or may have other geometric configurations.

A cutout 110 is defined on the curved portion 104 of the setter. When mounted on the extendible slide member, a first side end 112 of the setter is positioned facing the first end wall 22 of the housing when the setter is over the housing. A second side end 114 of the setter faces the second end 24 of the housing when the setter is over the housing, as for example shown in FIG. 12. The cutout 110 extends downward and toward the second side end of the setter.

The cutout has a first edge 116 of the setter closer to the first side end 112 of the setter. The first edge extends to a base 117 of the cutout. Beginning from a lower end 118 of the curved portion 104 of the setter, the first edge 116 has a first portion 120 which extends upwardly and toward the first side end of the setter at a first angle 122 relative to the horizontal 124. A second portion 126 of the edge extends from the first portion 120 upwardly and toward the first side end of the setter to a cutout base 117 at a second angle 128 relative to the horizontal 124 which is greater than the first angle 122.

A second edge 130 of the cutout, opposite the first edge, extends from the base 117 of the cutout and is closer to the second side end 114 of the setter than the first side end 112. The second edge extends downwardly and toward the second side end of the setter. The second edge does not extend as far downwardly as the base 118 of the curving portion of the setter. In an exemplary embodiment, the second edge extends to about half the distance of the first edge.

A third edge 132 extends from the second edge upwardly and towards the second side end of the setter. The intersections 134, 136, 138, 140 and 142 between the first portion and the second portion of the first edge, between the second portion of the first edge and the base of the cutout, between the base of the cutout and the second edge, between the second and third edges, and between the third edge and the second side end of the setter, respectively, are rounded.

Figure 12:
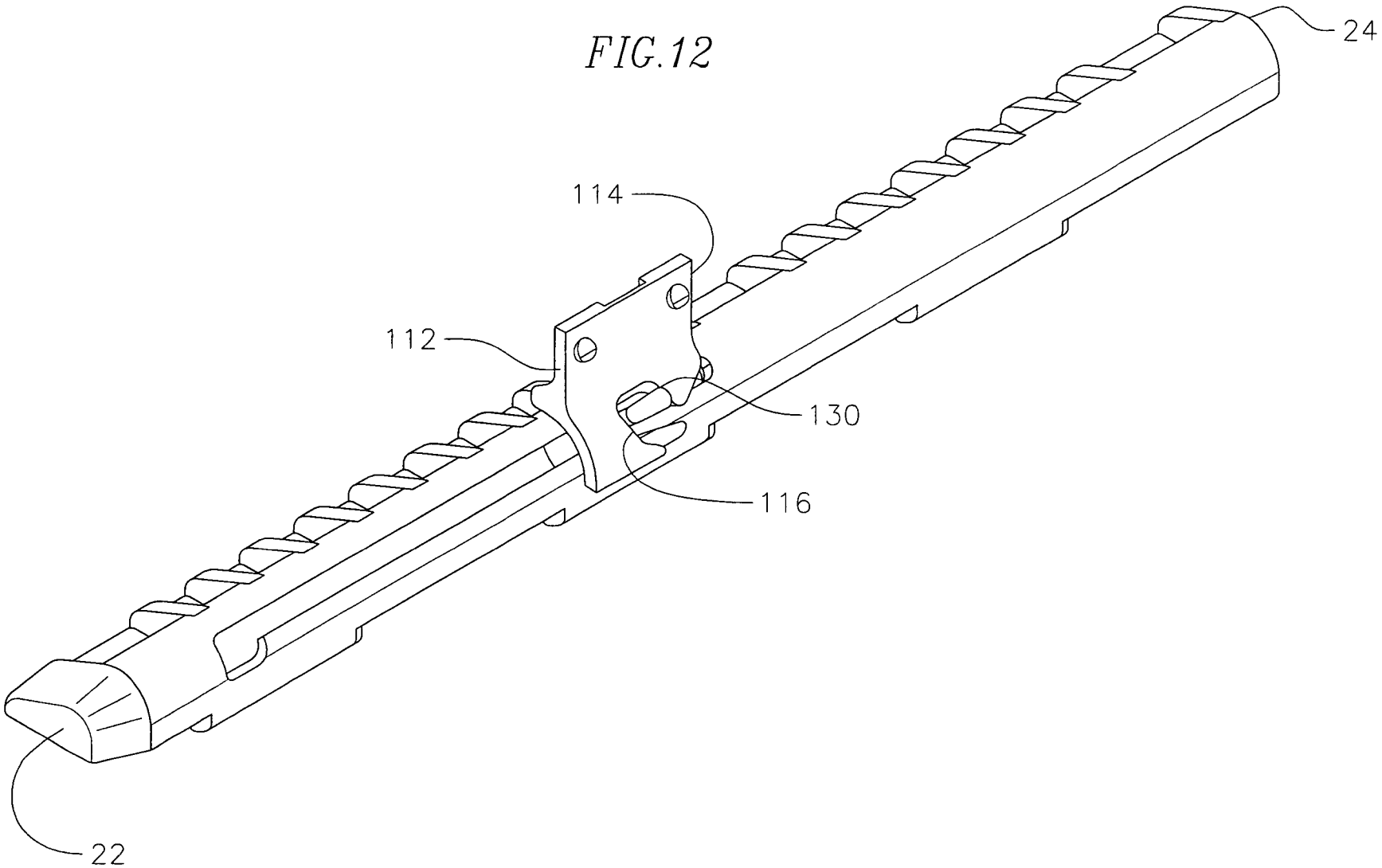
FIG. 12 is a perspective view of an exemplary embodiment self-moving mechanism of the present invention depicting an exemplary embodiment setter engaging an actuator of the exemplary embodiment self-moving mechanism.

The width of the cutout, i.e., the distance between the first and second edge, is sufficient to accommodate the actuator 40, as for example shown in FIG. 12. In other words, the spacing between the first and second edges of the cutout must be greater than the dimension of the actuator along the longitudinal axis of the setter.

Figure 13:
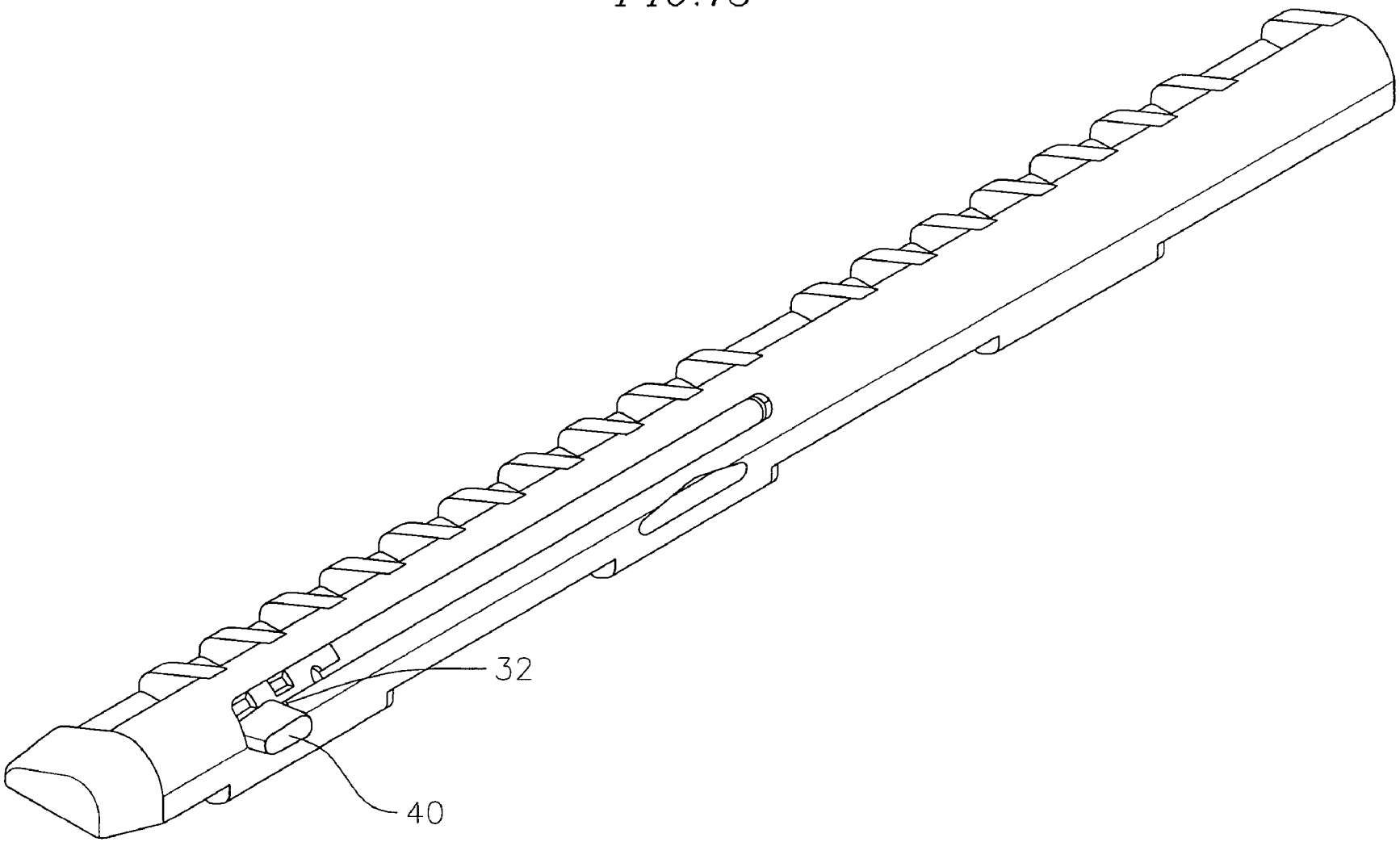
FIG. 13 is a perspective view of an exemplary embodiment self-moving mechanism with an actuator in an "armed" position.

When acting as a self-closing mechanism, and the slider is urged against the rib 60 within the housing and the actuator is within the setter cutout, the slide and the attached drawer should be in a closed position. In operation, the actuator is fitted within the cutout 110 on the curving portion of the setter. As a drawer is withdrawn from the cabinet, thereby extending the extendible slide member, the second edge 130 of the cutout exerts a force on the actuator 40 causing the actuator and the slider to slide along the longitudinal portion 28 of the guide slot along the cylindrical inner surface 14 of the housing. When the actuator reaches the end of the guide slot adjacent the transverse portion 30 of the guide slot, and as the extendible member continues the extend, the angle of the second edge of the setter causes the second edge to exert a force on the actuator as the actuator rides on edge 130 and rounded corner 140 of the setter. This force causes the slider to rotate about its central longitudinal central axis relative to the cylindrical inner surface of the housing and the actuator to move into the transverse portion 30 of the guide slot. When in this position, the spring is extended generating a force which urges the actuator against the shoulder 32 defined between the longitudinal and the transverse portions of the guide slot. The spring force also causes the actuator to remain engaged against the shoulder in an "armed" position, as for example shown in FIG. 13. As the drawer is further opened, the setter moves past the actuator.

As the drawer is moved toward a closed position, the first portion 120 of the first edge 116 of the setter engages the actuator and exerts a force on the actuator causing the slider to rotate about its central axis within the cylindrical inner surface 14 of the housing from the transverse portion toward the longitudinal portion of the guide slot. As the drawer and thus the extendible slide member and setter move further rearward towards a closed position, the actuator continues to be forced to rotate along the cylindrical inner surface section 14 of the housing until the actuator is aligned with the longitudinal portion 28 of the guide slot. When that occurs, the actuator, and thus the slider are urged by the spring force toward the guide slot end 62 (FIG. 1). Consequently, the actuator exerts a force on the second edge of 130 of the setter cutout causing the setter, and thus the extendible slide member and the drawer attached to it, to further retract to a closed position.

If while the drawer is in the open position, i.e., the extendible slide member is in the extended position, and the actuator accidentally "disarms" from the shoulder 32, i.e., the slider without the setter moves to the position along the guide slot and against the rib 62, the actuator can be reengaged with the setter. This can be accomplished by moving the drawer and thus the extendible slide member towards a retracted closed position. As the extendible slide member is moving toward a retracted closed position, the third edge 132 of the curved portion of the setter engages the actuator and exerts a force on the actuator causing the actuator to rotate relative to the cylindrical inner surface of the housing and against the thinner vertical wall portion 73 of the housing. Consequently, the thinner vertical wall portion flexes, collapsing the slot 71 allowing the actuator to further rotate. As the extendible slide member with the drawer are moved further toward the retracted position, the third edge 132 and rounded corner 140 move past the actuator. Consequently, the thinner vertical wall portion 73 flexes back to its original position rotating the actuator with the slider back to their original un-rotated position where the actuator engages the cutout 110 formed on the setter curved portion. When that occurs, the actuator is reengaged with the setter.

In another exemplary embodiment, the setter or at least a portion of the setter, such as portion 133 adjacent the cutout 110, may be formed from a flexible material or may otherwise be made flexible or compressible. In this regard when the actuator accidentally "disarms" from the shoulder 32, i.e., the slider without the setter moves to the position along the guide slot and against the rib 62, the actuator can be reengaged with the setter. This can be accomplished by moving the drawer and thus the extendible slide member towards and the setter towards a retracted position. As the extendible slide member is moving toward a retracted closed position, the third edge 132 of the curved portion of the setter engages the actuator. The actuator exerts a force on the setter causing the setter portion 133 to flex to allow the actuator to move into the setter cutout 110 and reengage with the setter.

The inventive self-moving mechanism can also be used as a self-opening mechanism by reversing the mounting of the mechanism on a stationary slide member. In further exemplary embodiment the housing may have a different exterior shape and/or the setter may have a different geometry as to be able to engage the actuator when appropriate.

In yet a further exemplary embodiment instead of being connected to the housing, the spring may be directly connected to the slide member on which the housing is mounted The housing, the slider with actuator and the setter may be formed from various materials, such as for example metals and plastics. In an exemplary embodiment, any or all of the housing, the slider with actuator and setter are formed from an acetate material. In another exemplary embodiment, any or all of the housing, the slider with actuator and setter are formed from a polymer.

Furthermore in other exemplary embodiments, the self-moving mechanism may be mounted on a non-stationary slide member, as for example an intermediate slide member for moving an extendible slide member slideably coupled to the non-stationary slide member.

The preceding description has been presented with reference to exemplary embodiments of the invention. Persons skilled in the art and technology to which this invention pertains will appreciate that alterations and changes in the described structures and methods of operation can be practiced without meaningfully departing from the principal, spirit and scope of this invention. Accordingly, the foregoing description should not be read as pertaining only to the precise structures and methods described and shown in the accompanying drawings.

The invention claimed is:

1. A self-moving slide comprising:

a first slide member;

a second slide member coupled to the first slide member, the first slide member extending and retracting relative to the second slide member;

a self-moving mechanism mounted on the second slide member, the self-moving mechanism comprising, a housing comprising a slot and an inner surface having a portion having a shape of at least a cylindrical section, and a slider having a body having an outer surface comprising at least a cylindrical section and a projection extending from the body, said projection penetrating the slot, said slider body cylindrical section sliding along said housing inner surface cylindrical section shape and rotating relative to said housing cylindrical section shape, and during rotation, the slider projection releasably coupling with the first slide member for moving the first slide member, the slot comprising a first portion and a second portion, the second portion being wider than the first portion, a shoulder being defined on the second portion adjacent the first portion, said shoulder dividing said first portion and said second portion, and wherein when in the slot second portion, the slider is rotatable relative to the housing for moving the slider projection over the shoulder, and whereby said housing cylindrical section shape serves to guide said slider body during sliding and during rotation; and a setter extending from the first slide member, said setter being separate from and coupled to said first slide member, the slider projection penetrating at least a portion of the setter and engaging the setter for coupling with the first slide member for moving the first slide member relative to the second slide member.

2. The self-moving slide as recited in claim 1 further comprising a spring coupled to the slider and the housing for moving the slider.

3. The self-moving slide as recited in claim 1 further comprising a spring coupled to the slider, wherein when the slider projection is over the shoulder, the spring generates a force urging the projection against the shoulder.

4. The self-moving slide as recited in claim 1 further comprising a spring coupled to the slider and the housing for moving the slider, wherein the spring comprises a first neck portion proximate a first end of the spring, wherein the first neck portion has a diameter smaller than a diameter of the first end of the spring, wherein the housing comprises a notch at a first end of the housing, wherein the diameter of the spring first end is greater than a width of the notch, and wherein the first neck portion is fitted within said notch.

5. The self-moving slide as recited in claim 4 wherein the spring comprises a second neck portion proximate a second end of the spring opposite the first end, wherein the second end is coupled to the body and wherein the second neck portion is fitted within a second notch defined on a wall extending from the inner surface of the housing.

6. The self-moving slide as recited in claim 5 wherein the spring generates a force urging the slider against the wall.

7. The self-moving slide as recited in claim 6 wherein the second end is fitted in a slot formed on the slider body, wherein the slot formed on the slider body comprises a wider section to accommodate the second end of the spring and a narrower section extending from the wider section to accommodate the second neck portion, wherein said slot formed on the slider body axially retains the second end of the spring relative to the body.

8. The self-moving slide as recited in claim 1 wherein the setter is separate from the first slide member and wherein the setter is coupled to the first slide member.

9. The self-moving slide as recited in claim 1 wherein the housing comprises an outer surface having a generally cylindrical section shape, wherein the housing slot is formed through said outer surface cylindrical section, wherein the setter comprises a surface having a generally cylindrical section shape, wherein said setter cylindrical section shape surface slides over the housing outer surface having a generally cylindrical section shape.

10. The self-moving slide as recited in claim 9 further comprising a slot formed through the setter for receiving the slider projection for engaging with the setter.

11. The self-moving slide as recited in claim 10 wherein the slider projection slides between a first position within the first portion of the housing slot and a second position within the second portion of the housing slot, wherein the setter slot is defined between first and second setter edges, wherein when the first slide member is extended relative to the second slide member, the setter causes the slider projection to slide to the second position against a force generated by the spring and the first edge of the setter causes the slider projection to rotate over the slot shoulder, and wherein the spring force causes the projection to engage the slot shoulder.

12. The self-moving slide as recited in claim 11 wherein when retracting the first slide member relative to the second slide member, the second edge of the setter engages the slider projection causing the slider to rotate to a position wherein the spring force causes the slider to slide toward the first position along the first portion of the housing slot, and wherein when sliding toward the first position, the projection applies a force on the setter for moving the first slide member.

13. The self-moving slide as recited in claim 12 wherein the housing is formed from plastic.

14. The self-moving slide as recited in claim 13 further comprising a cutout formed through the housing proximate an end of the housing slot first portion opposite the slot second portion for increasing the flexibility of a portion of housing proximate said cutout.

15. The self-moving slide as recited in claim 14 wherein the setter causes the slider to rotate and the slider projection to engage and flex said portion of the housing proximate said cutout allowing the slider projection to reengage the setter when the first slide member is retracted relative to the second slide member when the slide member projection is disengaged from said setter.

16. The self-moving slide as recited in claim 1 wherein at least a portion of the setter is compressible for being compressed by said slider projection during a reengagement with said setter.

17. The self-moving slide as recited in claim 1 wherein the housing comprises a slanted upper surface, wherein a lance tab extends from the second slide member and engages said slanted upper surface for retaining the housing on the second slide member.

18. The self-moving slide as recited in claim 1 further comprising a setter extending from the first slide member, wherein the slider projection engages the setter for coupling with the first slide member for moving the first slide member relative to the second slide member.

19. The self-moving slide as recited in claim 1 wherein the body comprises a depression and a lubricant within said depression.

20. The self-moving slide as recited in claim 1 wherein the body is self-lubricating.

21. The self-moving slide as recited in claim 1 wherein said self moving slide is an under-mount slide.

22. A self-moving slide comprising:

a first slide member;

a second slide member coupled to the first slide member, the first slide member extending and retracting relative to the second slide member; and a self-moving mechanism mounted on the second slide member, the self-moving mechanism comprising, a housing comprising a slot and an inner surface having a portion having a shape of at least a cylindrical section, a slider having a body having an outer surface comprising at least a generally cylindrical section and a projection extending from the body and penetrating the slot, said slider body cylindrical section sliding along said housing inner surface cylindrical section and rotating about said housing inner surface cylindrical section shape, the slot comprising a first portion and a second portion, the second portion being wider than the first portion and a shoulder being defined by the second portion adjacent the first portion, said shoulder dividing said first portion and said second portion, and wherein when in the slot second portion, the slider is rotatable relative to the housing for moving the slider projection over the shoulder, and whereby said housing inner surface cylindrical section shape serves to guide said slider body during sliding and during rotation; and a setter being separate from and coupled to said first slide member extending from the first slide member, the slider projection engaging the setter for moving the first slide member relative to the second slide member, wherein the slider projection slides between a first position within the first portion of the housing slot and a second position within the second portion of the housing slot, a setter slot being defined between first and second setter edges of the setter, the slider projection being received within the setter slot, wherein when the first slide member is extended relative to the second slide member, the setter causes the slider projection to slide to the second position against a force generated by the spring and the first edge of the setter causes the slider projection to rotate relative to said housing inner surface cylindrical section shape and over the slot shoulder, wherein the spring force causes the projection to engage the slot shoulder, and wherein when retracting the first slide member relative to the second slide member, the second edge of the setter engages the slider projection causing the slider to rotate relative to said housing inner surface portion and to a position wherein the spring force causes the slider to slide toward the first position along the housing slot first portion, wherein when sliding toward the first position, the projection applies a force on the setter for moving the first slide member.

23. The self-moving slide as recited in claim 22 wherein the setter is separate from, and coupled to, the first slide member.

24. The self-moving slide as recited in claim 22 wherein the housing is formed from plastic.

* * * * *

UNITED STATES PATENT AND TRADEMARK OFFICE

CERTIFICATE OF CORRECTION

PATENT NO. : 7,641,296 B2
APPLICATION NO. : 11/263682
DATED : January 5, 2010
INVENTOR(S) : Baoloc T. Le It is certified that error appears in the above-identified patent and that said Letters Patent is hereby corrected as shown below:

In the Claims

| | |
|---|---|
| Column 10, line 23, Claim 1 | Delete "and during rotation," |
| Column 12, line 7, Claim 21 | Insert -- - -- between "self" and "moving" |
| Column 12, line 19, Claim 22 | Delete "generally" |

Signed and Sealed this

Twenty-fourth Day of August, 2010

David J. Kappos

David J. Kappos
*Director of the United States Patent and Trademark Office*